US010683678B2

(12) United States Patent
Uka et al.

(10) Patent No.: US 10,683,678 B2
(45) Date of Patent: Jun. 16, 2020

(54) DOOR WITH DOOR FITTING

(71) Applicants: Fatos Uka, Bad Rappenau-Obergimpern (DE); Isabel Karcher, Bad Wimpfen (DE); Jan Karcher, Bad Wimpfen (DE)

(72) Inventors: Fatos Uka, Bad Rappenau-Obergimpern (DE); Isabel Karcher, Bad Wimpfen (DE); Jan Karcher, Bad Wimpfen (DE)

(73) Assignee: KARCHER GmbH, Bad Rappenau (DE)

( * ) Notice: Subject to any disclaimer, the term of this patent is extended or adjusted under 35 U.S.C. 154(b) by 295 days.

(21) Appl. No.: 15/481,089

(22) Filed: Apr. 6, 2017

(65) Prior Publication Data

US 2018/0291647 A1 Oct. 11, 2018

(51) Int. Cl.

| | |
|---|---|
| ***E05B 9/08*** | (2006.01) |
| ***E05B 15/02*** | (2006.01) |
| ***E05B 9/00*** | (2006.01) |
| *E05B 63/00* | (2006.01) |

(52) U.S. Cl.

CPC ..... *E05B 9/08* (2013.01); *E05B 9/002* (2013.01); *E05B 15/02* (2013.01); *E05B 63/0056* (2013.01)

(58) Field of Classification Search

CPC . E05B 9/08; E05B 9/002; E05B 9/082; E05B 15/02; E05B 63/0056; E05B 65/0025; E05B 9/004

USPC ..... 292/357

See application file for complete search history.

(56) References Cited

U.S. PATENT DOCUMENTS

| | | | | |
|---|---|---|---|---|
| 2004/0011095 | A1* | 1/2004 | Gotou | E05B 1/0092 70/208 |
| 2004/0040356 | A1* | 3/2004 | Su | E05B 9/082 70/370 |
| 2004/0222648 | A1* | 11/2004 | Shen | E05B 9/082 292/336.3 |
| 2004/0245788 | A1* | 12/2004 | Lin | E05B 63/006 292/336.3 |

OTHER PUBLICATIONS

Emtek Assa Abloy; Emtek Multi Point Lock Trim for Swing Patio Doors; non-patent literature; 17 pages; known prior to Apr. 6, 2017.

Baldwin; Multi-Point—How to Order; non-patent literature; 23 pages; known prior to Apr. 6, 2017.

* cited by examiner

*Primary Examiner* — Nathan Cumar

(74) *Attorney, Agent, or Firm* — Reinhart Boerner Van Deuren P.C.

(57) ABSTRACT

Provided is a door fitting, with an outer doorplate and with an inner doorplate, wherein the outer doorplate has a first opening on an inner side facing the inner doorplate, into which a shaft of a first screw can be screwed to fasten the outer doorplate to the door, and a second opening at a distance from the first end section in the lengthwise direction of the door fitting, into which a shaft of a second screw can be screwed to fasten the outer doorplate to the door. The door fitting can be adapted to various fitting situations if the first opening and/or the second opening is/are arranged on the outer doorplate so as to be displaceable in the lengthwise direction of the door fitting to allow different relative positions to be set between the outer doorplate and the first opening and/or the second opening.

15 Claims, 10 Drawing Sheets

DOOR WITH DOOR FITTING

The present invention relates to a door fitting for actuating a door locking mechanism of a door. The invention further relates to a door equipped with a door locking mechanism with such a door fitting.

BACKGROUND OF THE INVENTION

Doors which are equipped with such a door fitting or such a door locking mechanism may be normal house entrance doors. In such cases, however, they are preferably balcony doors or terrace doors.

A door fitting usually comprises an outer doorplate for mounting on the outside of the door and an inner doorplate for mounting on the inside of the door. Each doorplate covers openings that have been created in the door, through which a door locking mechanism fitted in the door can be accessed. Such a door locking mechanism typically comprises a mortise lock with a follower, which is equipped with a rectangular opening for actuating at least one latch of the mortise lock. An actuator rod may be pushed through the follower or the rectangular opening therein, and may be used to rotate the follower. This actuator rod expediently has a rectangular cross section. Then, said actuator rod must be pushed through the aforementioned openings formed in the door. The actuator rod also passes through further openings which are formed in the respective doorplate. The respective door fitting may then have one or two door openers, which are connected in non-rotating manner with the respective lengthwise end of the actuator rod at the respective doorplate. Such door openers may be designed as latches or as round handles or rotating knobs.

In this context, a central component of the door locking mechanism is the mortise lock, which is fitted in the narrow face of the door panel and includes said follower and the latch coupled thereto. Modern door locking mechanisms have at least one further latch, which is also coupled with the follower for drive purposes, and is arranged at a distance from the mortise lock in the door panel. In addition, the door locking mechanism may typically also be equipped with at least one bolt, which can be actuated with a barrel lock. In this context, the bolt and the latch may be separate components. Embodiments are also conceivable in which the latch may serve at the same time as the bolt, for example by extending it beyond its normal closure position additionally into a bolting position. This bolt is practically also conformed in the aforementioned mortise lock. Here too, it is conceivable to equip the door locking mechanism with at least one further bolt, which is integrated in the door at a distance from the mortise lock. Here too, it is conceivable to integrate the latch and the bolt in each other. In order to be able to insert such a barrel lock through the door and into the mortise lock and the door locking mechanism, openings are also necessary in the door. The respective doorplate may also have an opening suitable for a barrel lock, to enable the barrel lock to be actuated. Such a barrel lock may be actuated with a key, preferably on the outside of the door, and with a toggle which may preferably be provided on the inner side of the door. Accordingly, the door fitting may include the door openers, the barrel lock, and optionally a toggle as further components.

In order to fasten the doorplates to the door, an internal fastening may be used for reasons of security, to make it more difficult to remove the outer doorplate. For such an internal fastening, threaded connections are preferred in which the head of a screw bears on the inner doorplate, extends through the door and is screwed into a screw-in opening conformed on the outer doorplate. The door has two further passthrough openings to allow these screws to pass through. The positions of these passthrough openings relative to each other and relative to the door may vary depending on the respective door locking mechanism. Some mortise locks require that the passthrough openings for the screws are routed outside the mortise lock. In other mortise locks it is provided that one of two passthrough openings is routed through the mortise lock, while the other passthrough opening must be routed outside the mortise lock. Still other types require that both passthrough openings must pass through the mortise lock. In addition to all the above, depending on the type of mortise lock the follower may be positioned above the lock cylinder or below the lock cylinder, which means that the relative positions of the threaded joints on the door may also be varied. The logistical expense and the costs of providing a large number of different door fittings are relatively high.

BRIEF SUMMARY OF THE INVENTION

The present invention addresses the problem of describing an improved or at least a different embodiment of a door fitting of the type described previously, or a door equipped therewith, which is characterised particularly in that the respective door fitting can be used for multiple different door locking mechanisms.

This problem is solved according to the invention with the objects of the independent claims. Advantageous embodiments are objects of the dependent claims.

The invention is based on the general idea of designing the screwing points on the outer doorplate and on the inner doorplate via which the internal threaded joint is to be created between the outer doorplate and the inner doorplate through the door, so that they are displaceable relative to a longitudinal direction of the door fitting. In this way, a relative position of the screwing points with respect to each other and relative to the respective doorplate can be altered. This in turn enables an adjustment to various configurations and types of door locking mechanism. Accordingly, the door fitting according to the invention is usable for many different variants of door locking mechanism.

In detail, the door fitting according to the invention comprises an outer doorplate for mounting on an outer side of the door and an inner doorplate on an inner side of the door. The inner side of the outer doorplate, facing towards the inner doorplate has a first screw-in opening in a first end section of the door fitting, into which a shaft of a first screw may be screwed to fasten the outer doorplate to the door, and a second screw-in opening in a second end section of the door fitting at a distance from the first end section in the lengthwise direction of the door fitting, into which a shaft of a second screw can be screwed to fasten the outer doorplate to the door. The inner doorplate has a mounting plate and a covering plate that covers the mounting plate on the side outer side facing away from the outer doorplate. The first end section of the inner doorplate mounting plate has a first passthrough opening, through which the shaft of the first screw may be passed to fasten the mounting plate to the door, and the second end section has a second passthrough opening through which the shaft of the second screw may be passed to fasten the mounting plate to the door. The mounting plate also has a first bearing point on the outer side thereof, in the area of the first passthrough opening, on which a head of the first screw may bear either indirectly, e.g. via a washer, or directly, and a second bearing point in the area of the second passthrough opening, on which a head of the second screw may bear either indirectly, e.g. via a washer, or directly. It is further provided that when the door fitting is in the mounted state, the head of the first screw bears on the first bearing point, protrudes with its shaft through the first passthrough opening and through the door, and is screwed into the first screw-in opening. At the same time, the head of the second screw bears on the second bearing point and the shaft thereof protrudes through the second passthrough opening and through the door, and is screwed into the second screw-in opening. In this way, an internal threaded connection is created between the mounting plate and the outer doorplate through the door. In the mounted state, the inner doorplate is completed with the cover plate, wherein the cover plate then covers the mounting plate on the outer side thereof, so that the internal threaded connection is not visible, and also not accessible from the inner side of the door.

For the displaceability of the screwing point suggested according to the invention, it may now particularly be provided that the first screw-in opening and/or the second screw-in opening is/are arranged on the outer doorplate so as to be displaceable in the lengthwise direction of the door fitting, so that various distances may be set between the two screw-in openings and different relative positions may be set between the outer doorplate and the first screw-in opening and between the outer doorplate and the second screw-in opening.

According to an advantageous embodiment, the first passthrough opening may be configured with the first bearing point and/or the second passthrough opening may be configured with the second bearing point such that they allows the passing though and the bearing of the respective screw for various relative positions between the outer doorplate and the first screw-in opening and/or between the outer doorplate and the second screw-in opening. In other words, the respective passthrough opening is preferably not displaceable itself relative to the lengthwise direction of the door fitting, but it does enable the position of the bearing point for the screw head to be varied in the lengthwise direction.

According to an advantageous embodiment, the first screw-in opening may be conformed on a first carriage, which is arranged in a first carriage guide secured in the first end section on the outer doorplate so as to be displaceable in the lengthwise direction of the door fitting. Additionally or alternatively thereto, the second screw-in opening may be conformed on a second carriage, which is arranged in a second carriage guide secured in the second end section on the outer doorplate so as to be displaceable in the lengthwise direction of the door fitting. Thus, the respective carriage is displaceable in the lengthwise direction along the associated carriage guide, while it is supported against the carriage guide perpendicularly to the lengthwise direction. In this way, particularly tractive forces which are introduced into the carriage when the respective screw is tightened may be supported on the outer doorplate via the associated carriage guide. For this purpose, the respective carriage guide is fastened to the inside of the outer doorplate by suitable means. A welded joint is conceivable, for example.

In an advantageous refinement, the respective carriage guide may have a bracket which is fastened to the outer doorplate and a guide opening that extends in the lengthwise direction of the door fitting. As described earlier, the bracket may expediently be fastened to the outer doorplate by means of a welded joint. The bracket may then have a guide wall located at a distance from the inner side of the outer doorplate, in which the guide opening is formed and is delimited transversely to the lengthwise direction of the door fitting by two guide wall sections. The respective carriage may then protrude through the respective guide opening and engage in positive locking manner with the associated guide wall sections. In this way, the respective carriage may be braced against the bracket via the guide wall sections so that it is able to transmit the tractive forces described previously to the outer doorplate.

According to an advantageous refinement, the respective carriage may have a seating groove extending in the lengthwise direction of the door fitting for each guide wall section, with each of which one of the guide wall sections engages. To this extent, one groove and spring guide is created in conjunction with the respective carriage guide wall section on two sides of the respective carriage facing away from each other. Such a groove and spring guide or drawer guide not only ensures simple, guided displaceability of the carriage along the carriage guide but also serves to transmit powerful forces transversely to the direction of the guide.

The respective carriage may advantageously have a socket element which is fastened to the carriage body and displaceable along the respective carriage guide, and which contains the respective screw-in opening. This serves to make the respective carriage easier to manufacture.

A refinement in which the seating grooves are conformed on the carriage body is particularly advantageous. This enables a relatively compact construction of the socket element. The socket element may also be arranged centrally between the guide wall sections, and therewith in the region of the guide opening.

Another embodiment suggests that the respective carriage body has a lower part and an upper part, which may be fastened to each other by suitable means. This also simplifies the manufacture of the carriage. The socket element may then expediently have a screwing section with an external thread, while the lower part of the carriage body has a socket section with an internal thread that matches the external thread. In this way, the screwing section of the socket element may be screwed into the socket section of the lower part. Additionally, it may advantageously be provided that the upper part of the carriage body has a passthrough opening, which is in such a position and of such a size that the upper part may be fastened to the lower part with the aid of the socket element by screwing the screwing section into the socket section through the passthrough opening. At the same time, an area of the socket element protruding radially above the screwing section is braced against the upper part, namely against a border surrounding the passthrough opening. In this way, the upper part may be attached to the lower part with the aid of the socket element. The socket section may project away from the rest of the lower part and protrude axially into the passthrough opening of the upper part.

In an advantageous embodiment, the lower part may be arranged on an underside of the guide wall facing the inner side of the outer doorplate, so that the socket section is guided in the guide opening, and a lower part base, from which the socket section projects, engages behind the two guide wall sections transversely to the lengthwise direction of the door fitting. At the same time, the upper part may be arranged on an upper side facing away from the inner side of the outer door fitting, so that the passthrough opening is aligned with the socket section, and an upper part base which contains the passthrough opening engages across the two guide wall sections transversely to the lengthwise direction of the door fitting. When assembled, the lower part base and the upper part base in conjunction with the socket section form the seating grooves described earlier, in each of which one of the guide wall sections engages. The upper part, the lower part and the socket element may then be synchronised with each other so that when the socket element is tightened, that is to say when the screwing section is screwed tightly into the socket section, the lower part base and the upper part base press against the two guide wall sections to create a frictional retention of the respective carriage in the respective relative position along the guide opening. When the socket element is loosened, the frictional fastening is released, so that the carriage can be displaced along the guide opening, or along the guide wall sections.

According to another advantageous embodiment, it is suggested that a protruding pin be conformed on each side of the socket section on the lower part base, and is inserted through a pin passthrough opening in the respective guide wall section into a pin seating conformed on the upper part base. Alternatively, it may also be provided that a protruding pin is conformed on each side of the passthrough opening on the upper part base, and is inserted through a pin passthrough opening in the respective guide wall section into a pin seating conformed on the lower part base. The pin connection between the lower part base and the upper part base serves to prevent the lower part base and the upper part from twisting with respect to each other. The respective pin extending through the respective pin passthrough opening in the associated guide wall section also fixes the carriage on the carriage guide in the lengthwise direction of the door fitting in form-locking manner, which helps to secure the carriage more firmly for the screwing connection.

Another advantageous refinement provides that the respective guide wall section has several separate pin passthrough openings for at least two predefined relative positions between the outer doorplate and the first screw-in opening and/or the second screw-in opening, arranged at a distance from each other in the lengthwise direction of the door fitting. In other words, two or three or more separate and discrete pin passthrough openings then provided for two or three or more predefined relative positions, to enable the respective desired positioning of the carriage along the guide opening on the carriage guide.

Additionally or alternatively, it is also possible that the respective guide wall section has a common pin passthrough opening for at least two predefined relative positions between the outer doorplate and the first screw-in opening and/or the second screw-in opening, extending as an elongated slot in the lengthwise direction of the door fitting. In this way, an almost unlimited number of positions may be set for the carriage along the carriage guide.

However, a refinement is preferred in which a screen is created in the pin passthrough opening in the form of an elongated slot, which screen only permits the respective pin to pass through the pin passthrough opening when the predefined relative positions exist between the outer doorplate and the first screw-in opening and/or the second screw-in opening, and prevents the pin that has passed through this pin passthrough opening from being pushed in the lengthwise direction of the door fitting. The screen as well as the discrete and separate pin passthrough openings thus make the task of setting predefined relative positions considerably simpler for the fitter.

Advantageously for the embodiments described above which have separate pin passthrough openings and for shared passthrough openings which have a screen, with a screen described in the preceding text, the upper part, lower part and socket element are synchronised with each other so that the threaded joint between the screwing section and the socket section may be loosened to such an extent that the respective pin can be moved out of the respective pin passthrough opening without having to remove the socket element completely from the lower part of the carriage for this purpose. In this way, the carriage may then be shifted as a unit along the carriage guide to set the desired relative position. Once the desired relative position has been found, the threaded joint between the screwing section and the socket section may be tightened again. Since in this configuration the position of the carriage relative to the carriage guide is secured by the separate pin passthrough openings or by the screen in the respective common pin passthrough opening, when the threaded joint between the screwing section and the socket section is tight the respective guide wall sections between the lower part base and the upper part base must not be placed under any tension. In general, however, an embodiment is preferred in which such a tension of the guide wall sections between the lower part base and the upper part base does occur when the screwing section is screwed tight to the socket section.

As was explained earlier, the socket section preferably projects away from the rest of the lower part, preferably towards the upper part. In this context, it is particularly advantageous if the socket section protrudes axially into the passthrough opening of the upper part, at least when the screwing section is screwed tightly to the socket section for fixing the relative position of the carriage on the carriage guide.

In another advantageous embodiment, it is suggested that a tool engagement point be conformed radially outwardly on the socket element, via which a torque may be applied by means of a tool. In this way, a predefined and preferably relatively large torque can be applied to tighten and loosen the screwed joint between the screwing section and the socket section with the aid of a suitable tool. This ensures that when loosening a screw that is screwed into the screw-in opening in the socket element to affix the mounting plate and the outer doorplate on the door, the torque required to loosen the screw in the screwed joint between the screw shaft and the screw-in opening is less than the torque required to loosen the screwed connection between the screwing section and the socket section.

A door according to the invention comprises a door locking mechanism for securing the door in a door frame in the closed state, and is also furnished with a door fitting of the type described in the preceding text, which serves to actuate the door locking mechanism.

It goes without saying the door fitting may additionally include at least one door opener, in the form of a latch or in the form of a rotating knob and/or a barrel lock for example. Said screws and possibly suitable washers may also be included as part of the door fitting. The actuator rod for coupling the respective door openers with the follower of the door locking mechanism may also belong to the door fitting equipment.

Further important features and advantages of the invention will be evident from the subordinate claims, the drawing and the associated description of the figures with reference to the drawing.

Of course, the features described previously and those that will be explained in the following text are usable not only in the combinations described but also in other combinations or individually without departing from the scope of the present invention.

Preferred embodiments of the invention are represented in the drawing and will be explained in greater detail in the following description, wherein identical or similar or functional equivalent components are identified with the same reference signs.

BRIEF DESCRIPTION OF THE SEVERAL VIEWS OF THE DRAWING

In the drawing, of which all parts are represented schematically.

DETAILED DESCRIPTION OF THE INVENTION

Figure 1:
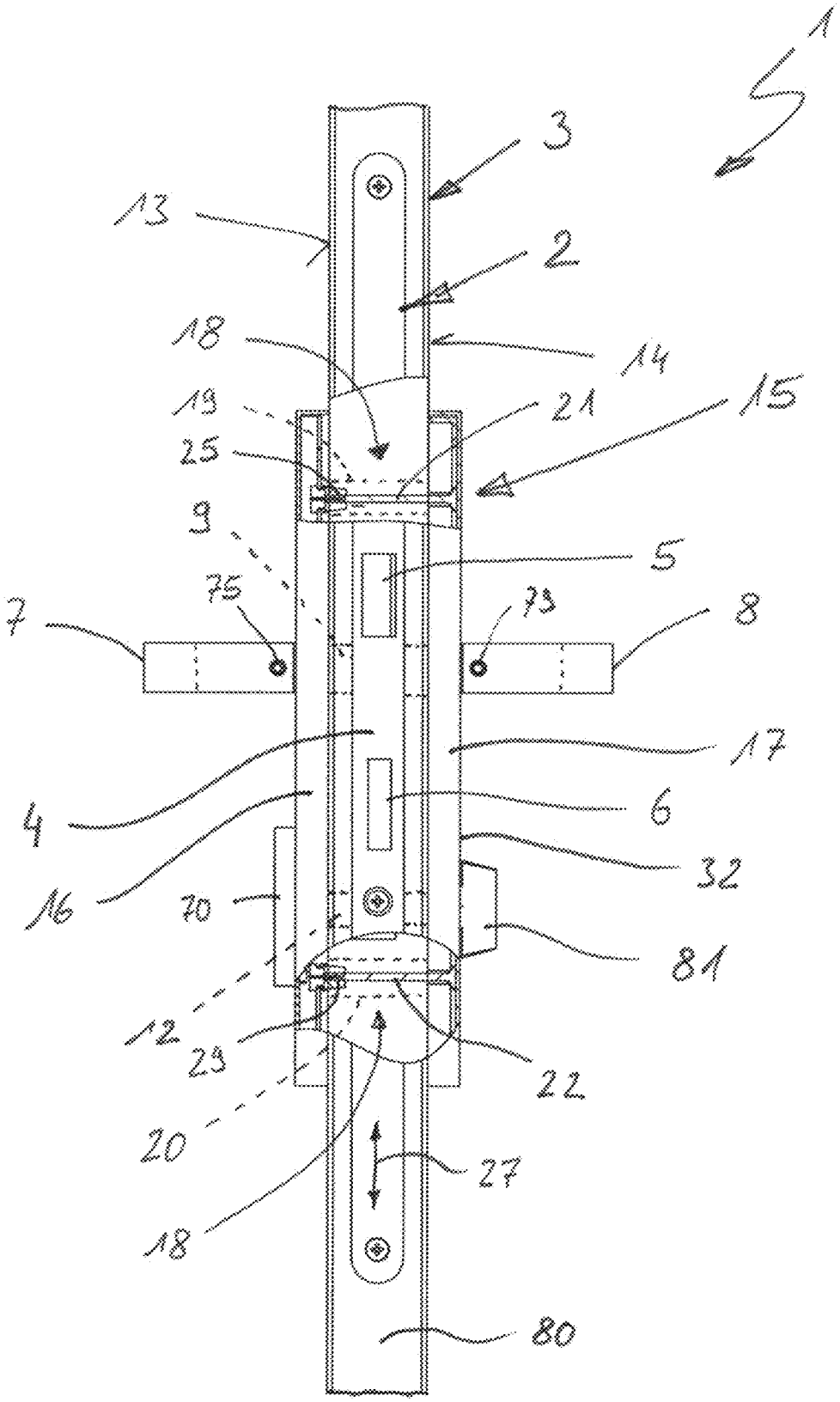
FIG. 1 is a simplified view of the narrow face of a door in the area of a door fitting.
Figure 2A:
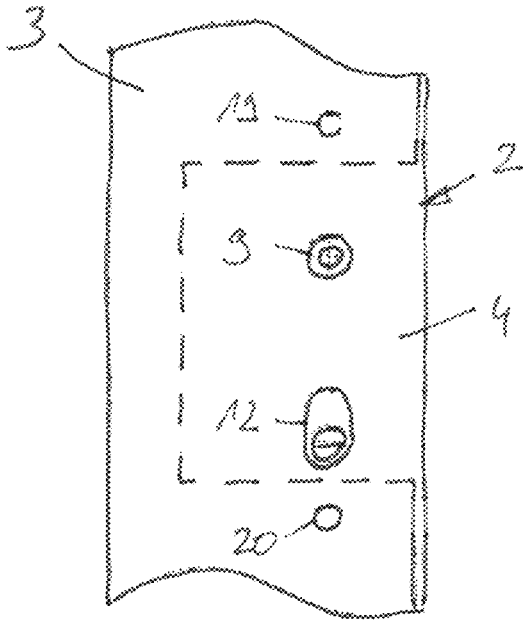
FIGS. 2*a*-2*d* shows various simplified views of the door without a door fitting in the area of a door locking mechanism for different variants a to d of the door locking mechanism.
Figure 2B:
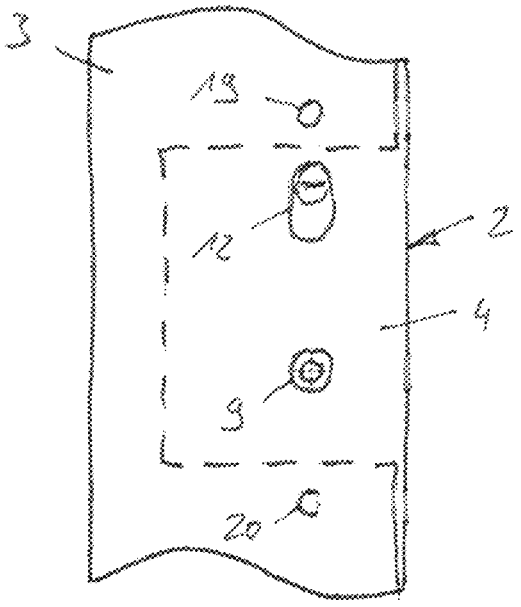
Figure 2C:
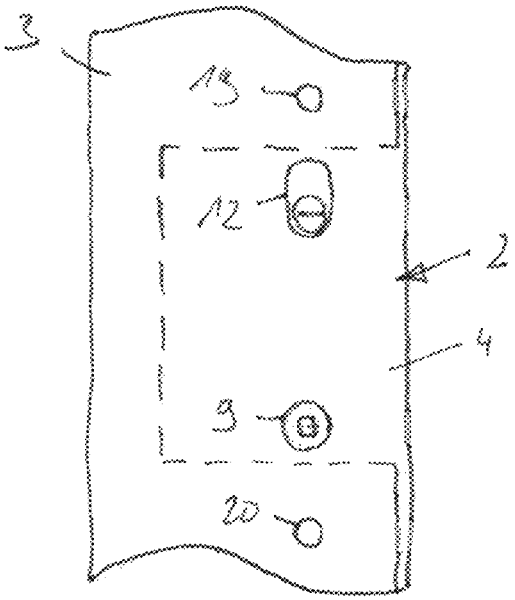
Figure 2D:
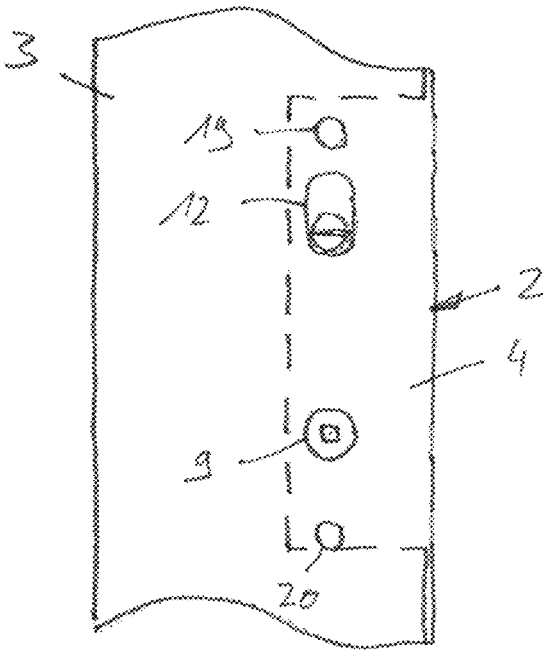
Figure 3:
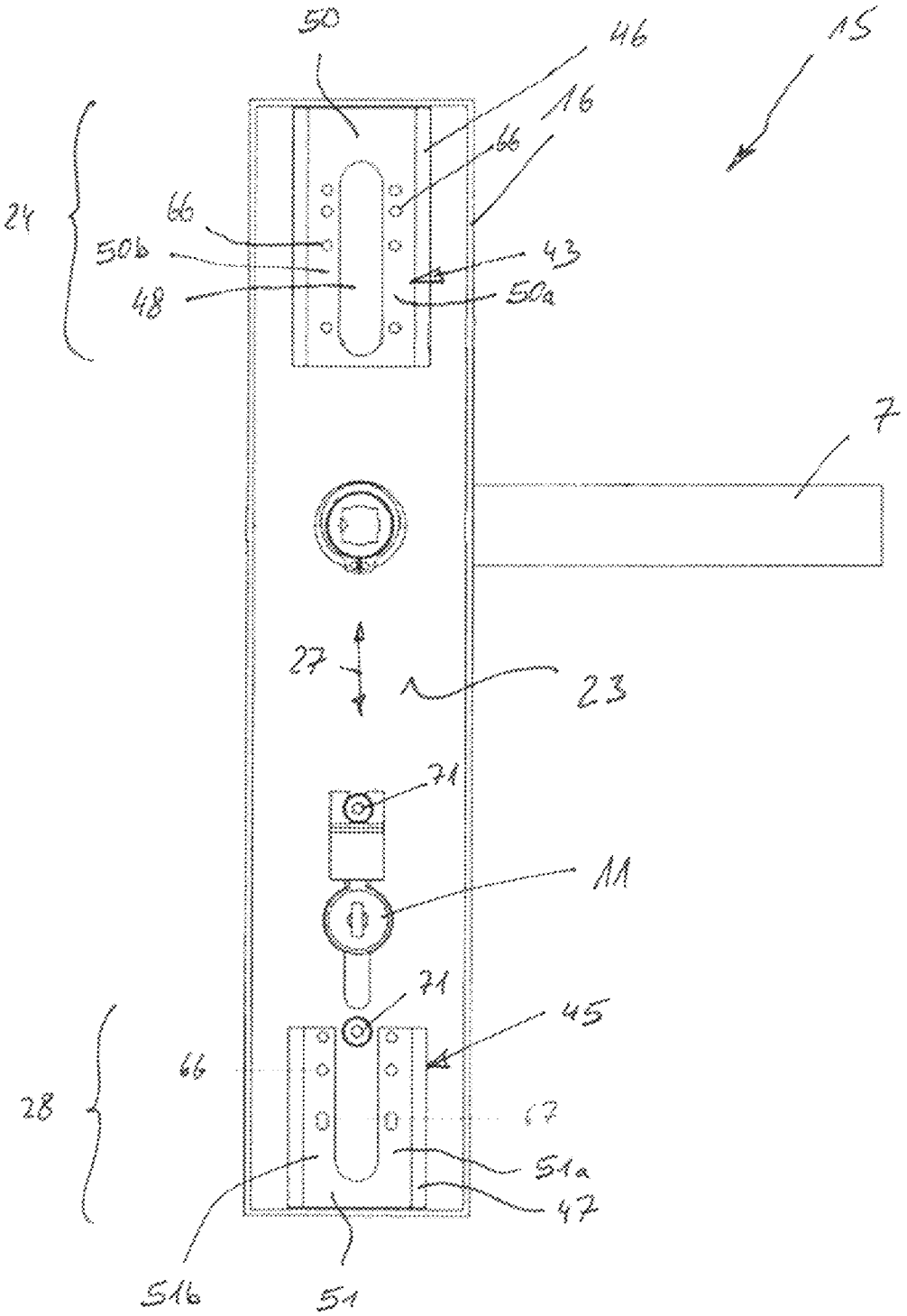
FIG. 3 is a view of an inner side of an outer doorplate of the door fitting.

According to FIG. 1, a door 1 comprises a door locking mechanism 2, which is largely integrated in a door panel 3 of door 1. FIG. 1 shows a mortise lock 4 which is built into door panel 3 and forms part of door locking mechanism 2. Mortise lock 4 is embedded n the usual way in the narrow face 80 of door panel 3 facing towards the observer. In a simple embodiment, door locking mechanism 2 may consist of the mortise lock 4. Mortise lock 4 has a latch 5 for securing door 1 in a door frame in a closed state. In addition, mortise lock 4 may be furnished with a bolt 6 for bolting door 1 in the door frame in the closed state. In the example of FIG. 1, latch 5 and bolt 6 are separate components. In other embodiments, the function of bolt 6 may be integrated in latch 5. For example, latch 5 may be extended beyond its normal securing position into a bolting position for locking.

Modern door locking mechanisms 2 may include additional latches 5 and/or additional bolts 6 for increased security, which are also integrated in door panel 3 and are then arranged above or below mortise lock 4 and at a distance from mortise lock 4.

Figure 5:
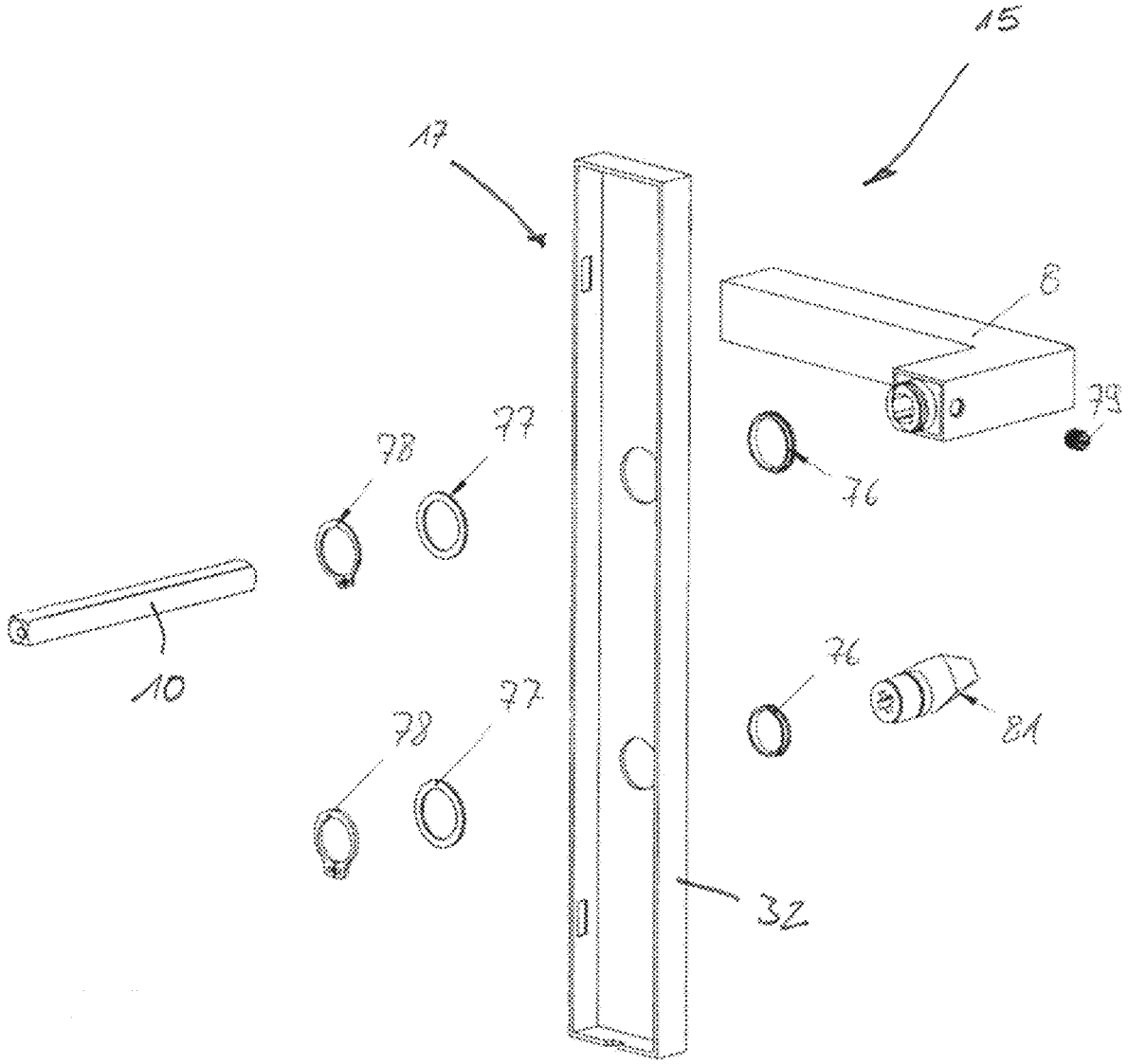
FIG. 5 is an exploded isometric view of an inner doorplate of the fitting, with further components of the fitting.

Latch 5 is typically actuated via door openers 7, 8, which in this case are in the form of latches. To ensure that the respective door handle 7, 8 is able to cooperate through door panel 3 with door locking mechanism 2 and mortise lock 4 to actuate the latch 5, a first actuating opening 9 must be created in door panel 3. For example, an actuating pin 10 as shown in FIG. 5 may be pushed through this first actuating opening 9, simultaneously connecting both door openers 7, 8 to each other in non-rotating manner.

Figure 4:
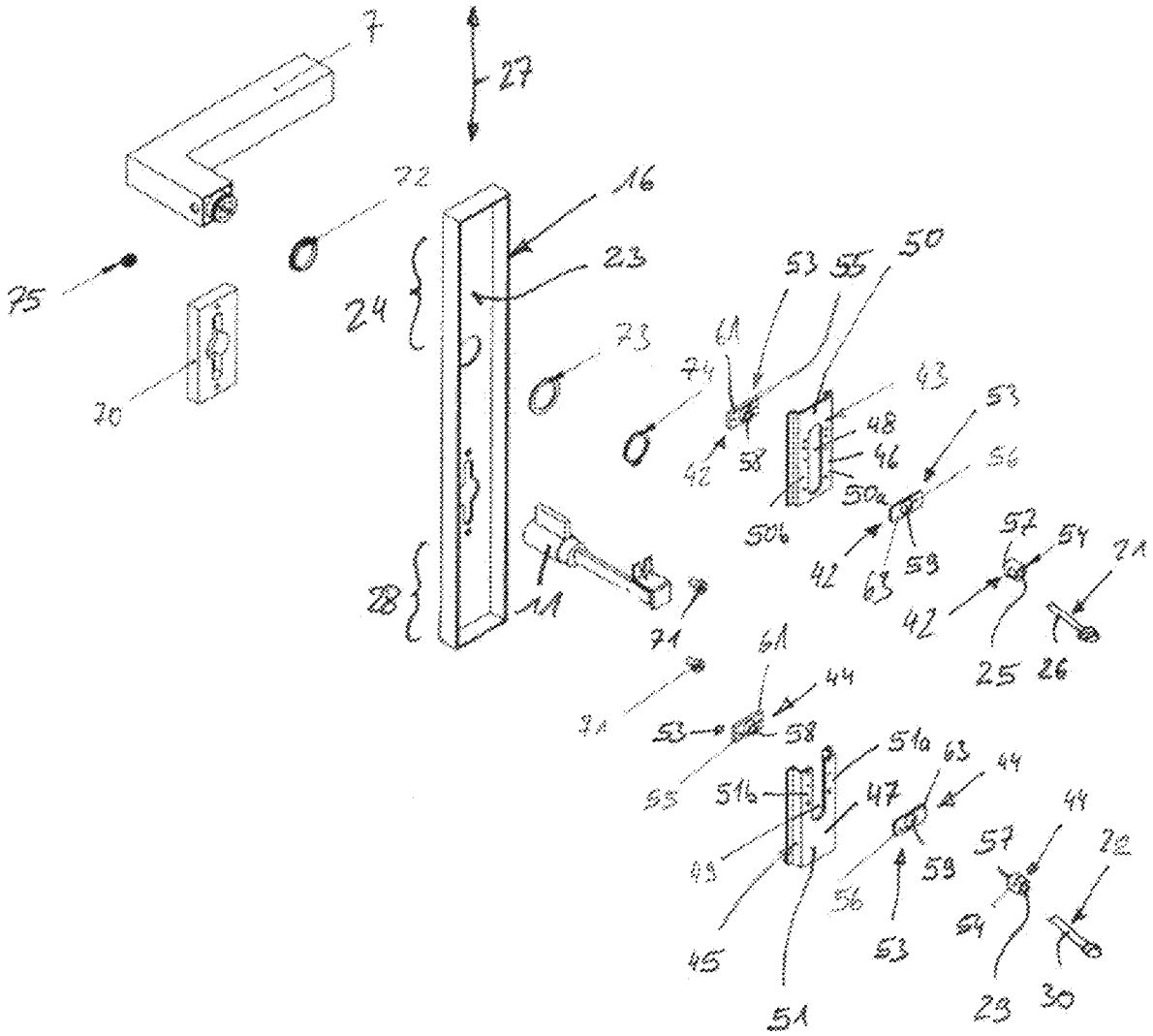
FIG. 4 is an exploded isometric view of the outer doorplate with further components of the door fitting.

In order to actuate bolt 6, a barrel lock 11 as shown in FIG. 4 may be provided which passes through a second actuating opening 12 conformed in door panel 3 so that it may be actuated for example on a door external side 13 with the aid of a key (not shown here) or on a door internal side with the aid of a toggle 81 to actuate bolt 6 for locking and unlocking.

Figure 14:
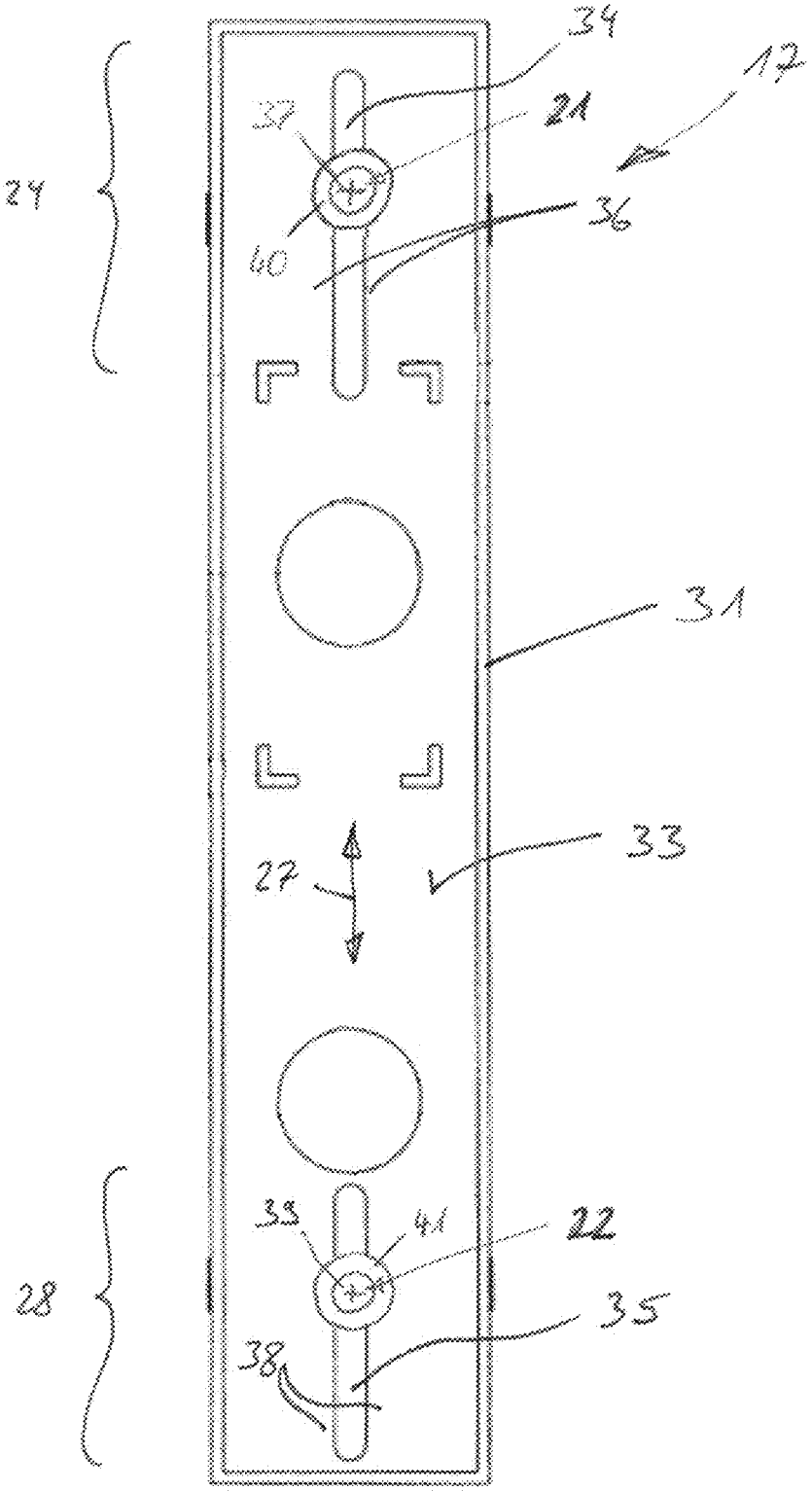
FIG. 14 is a view of an outer side of a mounting plate of the inner doorplate.

Door 1 is further equipped with a door fitting 15, which generally serves to actuate door locking mechanism 2 and may accordingly comprise actuating pin 10 and also the barrel lock 11. Door fitting 15 may also comprise door openers 7, 8 and toggle 81. Regardless of the components mentioned earlier, at all events door fitting 15 comprises an outer doorplate 16 for mounting on the door outer side 13 and an inner doorplate 17 for mounting on the door inner side 14. Outer doorplate 16 and inner doorplate 17 are fastened to each other via an internal threaded joint 18 through door panel 3, and thus are also fastened to door 1 and door panel 3. In order to create this internal threaded joint 18 at least two screw passthrough openings are created in door panel 3, in particular a first screw passthrough opening 19 and a second screw passthrough opening 20, through which a screw, particularly a first screw 21 and a second screw 22 may be passed, as shown in FIGS. 1, 4 and 14.

According to FIGS. 2*a* to 2*d*, different variants exist for door locking mechanism 2 and for the mortise lock 4 of door locking mechanism 2. These different variants differ from each other in that the individual passthrough openings that pass through the door or door panel 3, that is to say the two actuating openings 9, 12 and the two screw passthrough openings 19, 20 may have different relative positions with respect to each other. The distances between the two screw passthrough openings 19, 20 and the distances from the first actuating opening 9 and from the second actuating opening 12 may be varied. The door fitting 15 presented here enables simple adaptation to the variable positions of screw passthrough openings 19, 20.

For this purpose, as shown in FIG. 4 the inner side 23 of outer doorplate 16 facing inner doorplate 17 has a first screw-in opening 25 in a first end section 24 of door fitting 15, into which opening a shaft 26 of the first screw 21 can be screwed to fasten outer doorplate 16 to door 1 or door panel 3. Outer doorplate 16 further has a second screw-in opening 29 on the inner side 23 in a second end section 28 of door fitting 15 at a distance from the first end section 24 in the lengthwise direction 27 of door fitting 15, into which a shaft 30 of the second screw 22 can be screwed to fasten the outer doorplate 16 to door 1 or door panel 3. The inner doorplate 17 has a mounting plate 31, shown in FIG. 14, and a cover plate 32 which appears in FIGS. 1 and 5. When assembled, cover plate 32 covers mounting plate 31 on an external side 33 facing away from the outer doorplate 16, and facing towards the observer in FIG. 14. According to FIG. 14, mounting plate 31 has a first passthrough opening 34 in first end section 24, through which shaft 26 of first screw 21 can be passed to fasten mounting plate 31 to door 1. In the second end section 28 of door fitting 15, mounting plate 31 has a second passthrough opening 35, through which shaft 30 of the second screw 22 can be passed to fasten mounting plate 31 to door 1. A first bearing point 36 is provided in the area of the first passthrough opening 34 on the outer side 33 of mounting plate 31, which bearing point is formed in the example shown by an opening border, which surrounds first passthrough opening 34. A head 37 of first screw 21 may be supported on this first bearing point 36. A second bearing point 38 is conformed in the region of the second passthrough opening 35, formed in this case by an opening border which surrounds second passthrough opening 35. A head 39 of the second screw 22 may be supported on this second bearing point 38. When door fitting 15 is mounted, as indicated in FIG. 1, the first screw 21 is supported directly on first bearing point 36, as shown in FIG. 1, or indirectly as shown in FIG. 14, for example via a washer 40, extends through first passthrough opening 34 and through door 1 through the first screw passthrough opening 19, and is screwed into first screw-in opening 25. Second screw 22 is supported indirectly on the second bearing point 38, as shown in FIG. 14, particularly via a washer 41, or directly as shown in FIG. 1, extends through second passthrough opening 35 and through door 1 through the second screw passthrough opening 20, and is screwed into second screw-in opening 29.

First screw-in opening 25 and/or second screw-in opening 29 is arranged on outer doorplate 16 so as to be displaceable in the lengthwise direction 27 of door fitting 15. In this way, various distances may be set between first screw-in opening 25 and second screw-in opening 29, and various relative positions between outer doorplate 16 and the respective screw-in opening 25, 29. Preferably, the two screw-in openings 25, 29 are each arranged so as to be displaceable in lengthwise direction 27 of door fitting 15 relative to outer doorplate 16. It is further provided that first passthrough opening 34 with first bearing point 36 and/or second passthrough opening 35 with second bearing point 38 are designed such that they allow the respective screw 21, 22 to pass through and bear on the bearing point for various relative positions between outer doorplate 16 and first screw-in opening 25 and/or second screw-in opening 29. It is also advantageously provided here that both passthrough openings 34, 35 with the associated bearing point 36, 38 allow the respective screw 21, 22 to pass through and bear on the bearing point for various relative positions between outer doorplate 16 and the respective screw-in opening 25, 29, so that in each case a consistent alignment between outer doorplate 16 and inner doorplate 17 may be set, aligned transversely to the plane of door panel 3. In the example of FIG. 14, this is achieved simply in that the respective passthrough opening 34, 35 is designed as an elongated slot which extends parallel to the lengthwise direction 27 of door fitting 15.

With regard to the displaceability of screw-in openings 25, 29, it is provided in the door fitting 15 presented here, particularly according to FIG. 4, that first screw-in opening 25 is conformed on a first carriage 42. which is arranged so as to be displaceable in der lengthwise direction 27 of door fitting 15 in a carriage guide 43 that is fastened to outer doorplate 16 in first end section 24. The second screw-in opening 29 is also conformed on a second carriage 44, which is arranged so as to be displaceable in der lengthwise direction 27 of door fitting 15 in a second carriage guide 45 that is fastened to the outer doorplate 16 in the second end section 28.

Figure 13:
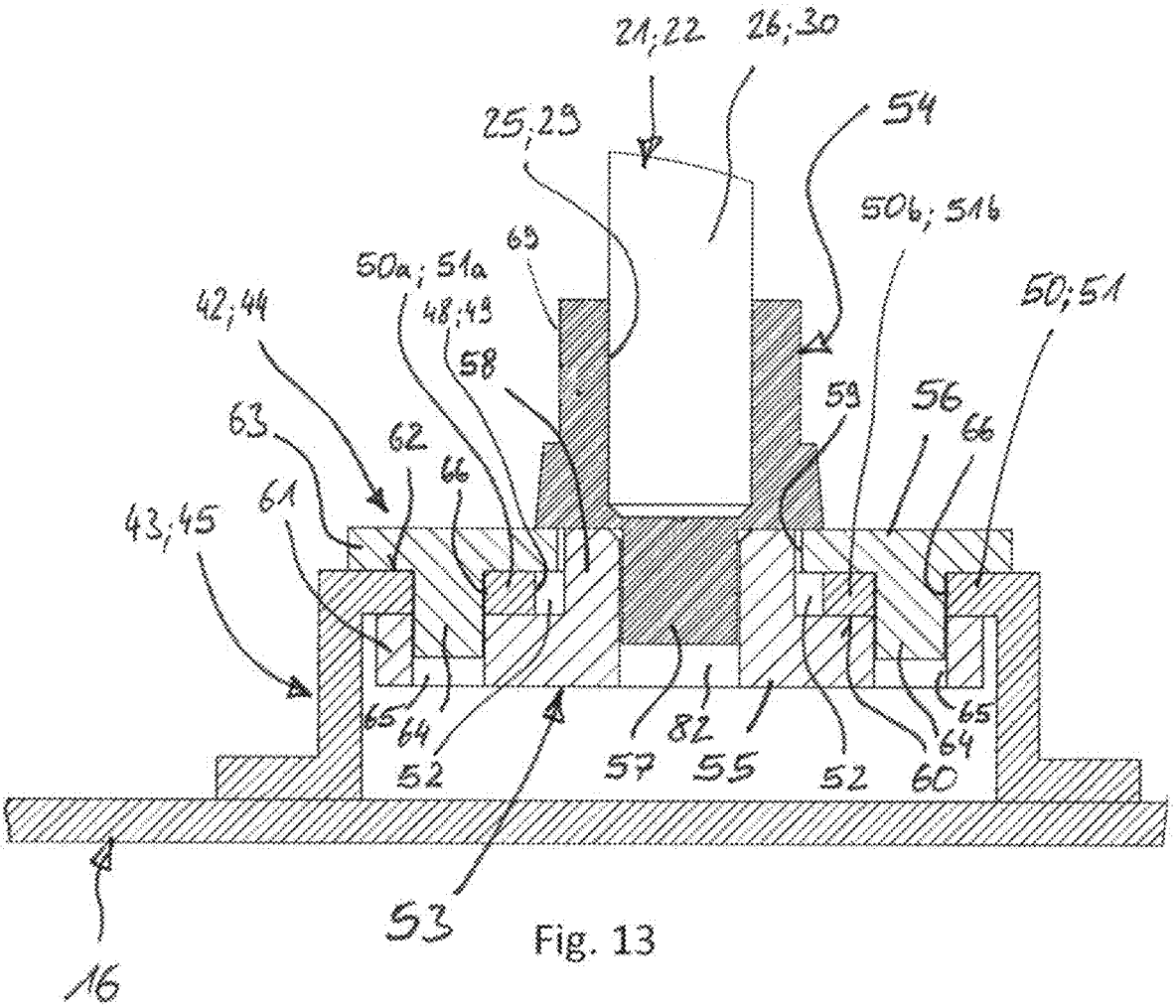
FIG. 13 is a cross section of the outer doorplate in the area of a carriage in the mounted state.

Each respective carriage guide 43, 45 is equipped with a bracket 46 or 47 fasted to outer doorplate 16 and a guide opening 48, 49 extending in the lengthwise direction 27 of door fitting 15. Bracket 46, 47 has a guide wall 50, 51 which is located at a distance from the inner side 23 of outer doorplate 16, and in which the guide opening 48, 49 is formed. Two guide wall sections 50*a*, 50*b* and 51*a*, 51*b* delimit the respective guide opening 48, 49 transversely to the lengthwise direction 27 of door fitting 15. The associated carriage 42 or 44 passes through respective guide opening 48, 49 and is in form-locking engagement with the associated guide wall sections 50*a*, 50*b* and 51*a*, 51*b*. The interaction between the respective carriages 42, 44 and the associated carriage guide 43, 45 is represented in greater detail in FIG. 13. The respective carriage 42, 44 evidently defines a seating groove 52 for each guide wall section 50*a*, 50*b* and 51*a*, 51*b*, in each of which one guide wall section 50*a*, 50*b*, 51*a*, 51*b* engages. It is further discernible that the respective carriage 42, 44 has a carriage body 53 which is displaceable along the respective carriage guide 43, 45 and a socket element 54. Socket element 54 is fastened to carriage body 53 and contains the respective screw-in opening 25 and 29. The aforementioned seating grooves 52 are conformed on carriage body 53.

The embodiment shown here is particularly advantageous, since carriage body 53 has a lower part 55 and an upper part 56. Socket element 54 also has a screwing section 57, which is furnished with an external thread. Lower part 55 is equipped with a socket section 58 which has a threaded opening 82 with an internal thread that matches the external thread of screw section 57. Socket section 58 projects visibly away from the rest of lower part 55. Upper part 56 has a passthrough opening 59. The individual components of carriage 42 and 44 now cooperate as follows. Upper part 56 may be fastened to lower part 66 with the aid of socket element 54, for which screwing section 57 passes through passthrough opening 59 and is screwed into socket section 58. In the assembled state, lower part 55 is arranged on an underside 60 of the respective guide wall 50 or 51 facing towards the inner side 23 of outer doorplate 16, which underside is facing away from the observer in FIGS. 6 and 7. Lower part 55 is positioned in such manner that socket section 58 is supported in guide opening 48 or 49, whereas a lower part base 61, from which socket section 58 protrudes away, engages behind both guide wall sections 50*a*, 50*b* and 51*a*, 51*b* transversely to the lengthwise direction 27 of door fitting 15. On the other hand, the upper part 56 is arranged on an upper side 62 of guide wall 50 or 51 facing away from inner side 23 of outer door fitting 16, which upper side is facing towards the observer in FIGS. 6 and 7. Upper part 56 is arranged such that passthrough opening 59 is aligned with socket section 58 and an upper part base 63 containing passthrough opening 59 engages across the two guide wall sections 50*a*, 50*b* and 51*a*, 51*b*, transversely to the lengthwise direction 27 of door fitting 15.

According to FIGS. 10 to 13, a protruding pin 64 may be conformed on each side of the passthrough opening 59 on upper part base 53. As a counterpart thereto, a pin seating 65 may be conformed on each side of socket section 58 on lower part base 61. The respective pin seating 65 is also shaped to match the respective pin 64, so that the respective pin 64 can be inserted in the associated pin seating 65. Pins 64 and pin seatings 65 are arranged eccentrically relative to passthrough opening 59 and relative to socket section 58 to such a degree that the respective pin 64 then passes through a pin passthrough opening 66 which is illustrated in greater detail in FIGS. 6, 7 and 13.

Figure 6:
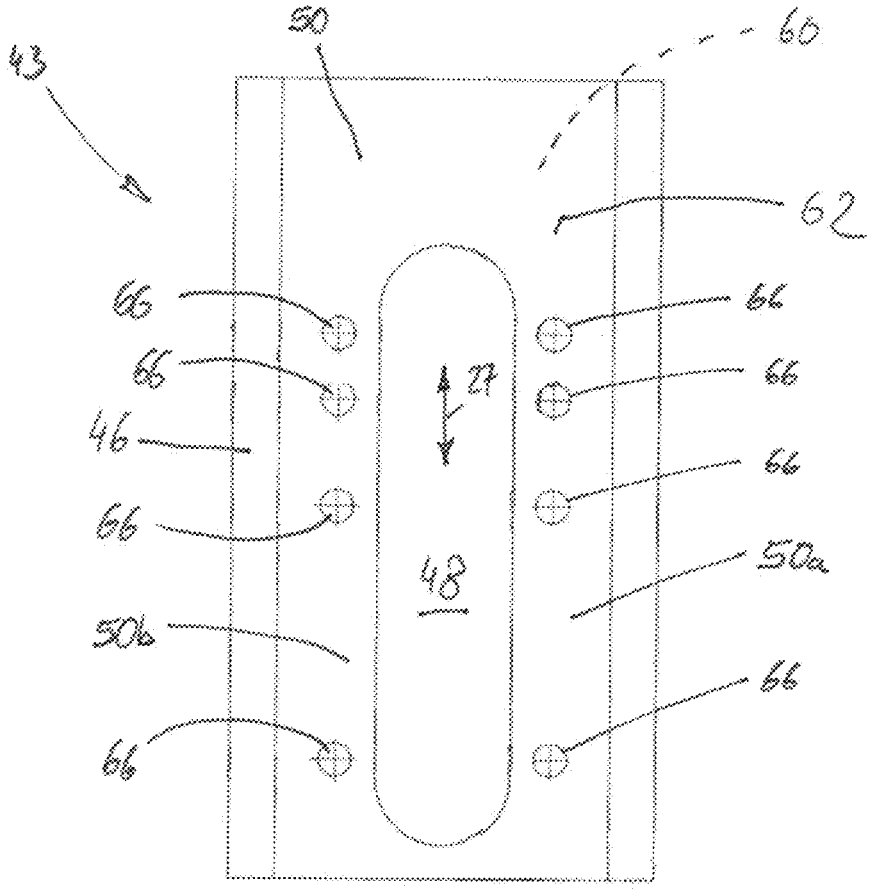
FIG. 6 is a view of a first carriage guide of the outer doorplate.

According to FIG. 6, for purely exemplary purposes first carriage guide 43 has four separate pin passthrough openings 66, through each of which a pin 64 from carriage body 53 can pass. In this was a total of four different relative positions between outer doorplate 16 and first carriage 52, and thus also first screw-in opening 25, are defined with the aid of these four separate pin passthrough openings 66.

Figure 7:
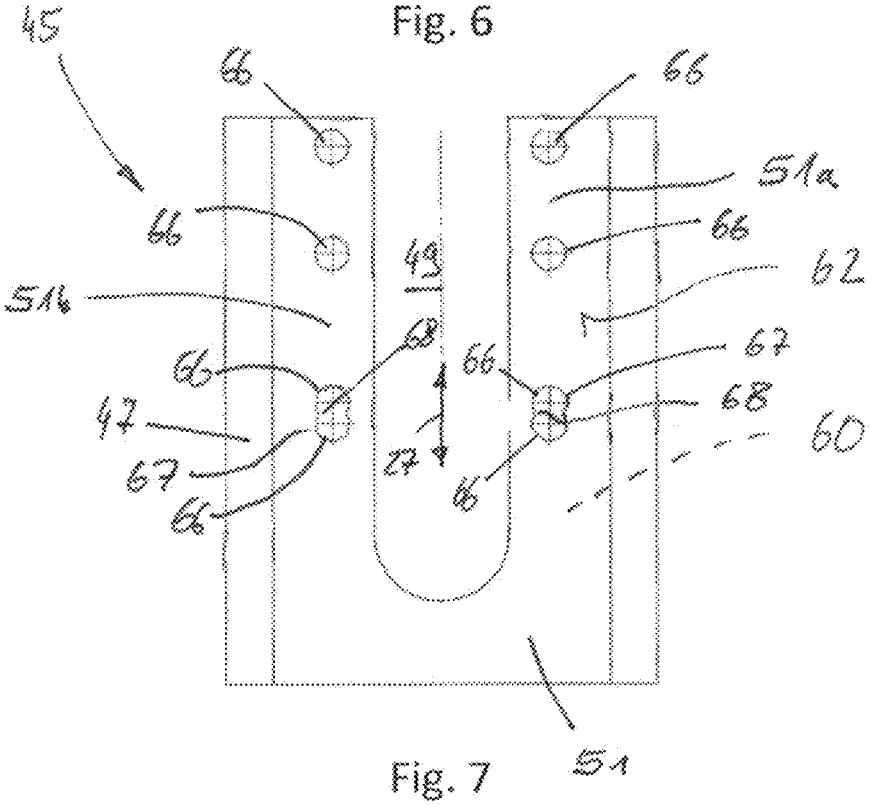
FIG. 7 is a view of a second carriage guide of the outer doorplate.

According to FIG. 7, second carriage guide 45 has exactly two separate pin passthrough openings 66. For purely exemplary purposes, second carriage guide 50 also has a common carriage passthrough opening 67, which enables at least two different relative positions for the respective pin 64. For this purpose, this common pin passthrough opening 67 is designed as an elongated slot which extends parallel to the lengthwise direction 27 of door fitting 15. In the preferred example shown here, a screen 68 is formed in the common pin passthrough opening 67 which is configured as an elongated slot. This screen 68 allows the respective pin 64 to pass through common pin passthrough opening 67 only when individual, separate, predefined relative positions exist between the respective screw-in opening, in this case the second screw-in opening 29, and the outer doorplate 16. The screen 68 also prevents pin 64 that has passed through said common pin passthrough opening 67 from being pushed in the lengthwise direction 27 of door fitting 15.

It is evident that the common pin passthrough opening 67 equipped with screen 68 may also be configured for more than two separate relative positions, particularly for all predefined relative positions between the associated screw-in opening 25, 29 and the outer doorplate 16.

Advantageously, socket section 58 is dimensioned such that it protrudes through guide opening 48 or 49 into passthrough opening 59.

Figure 8:
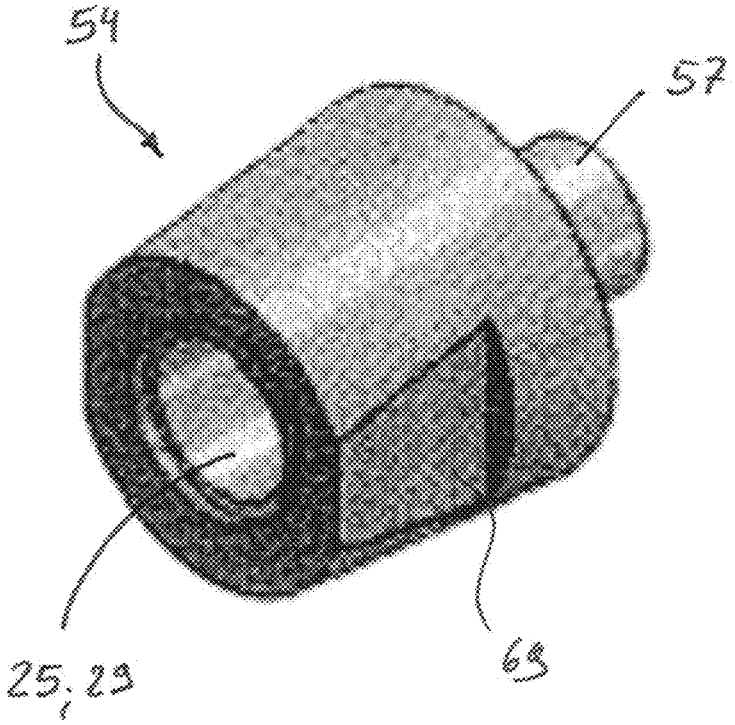
FIG. 8 is an isometric view of a socket element of a carriage of the outer doorplate.
Figure 9:
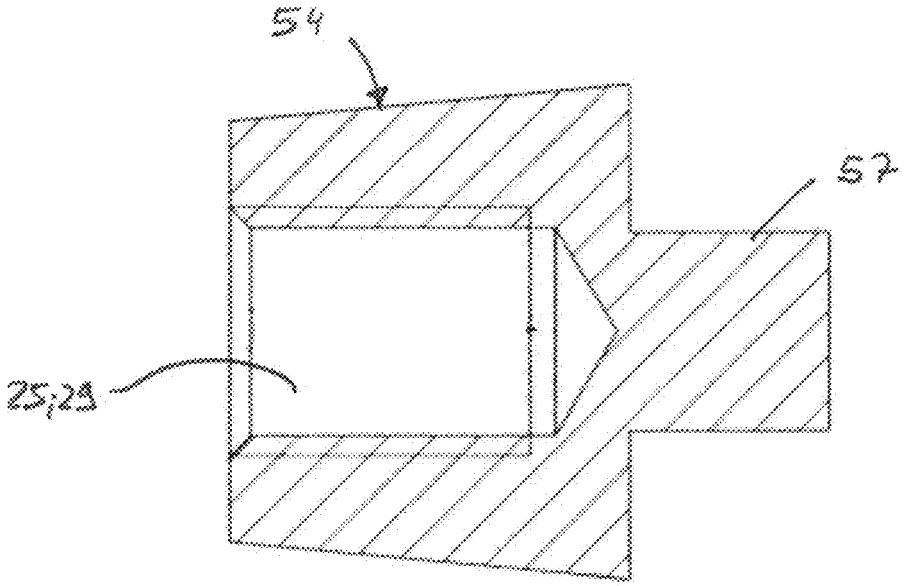
FIG. 9 is a cross section through the socket element.
Figure 10:
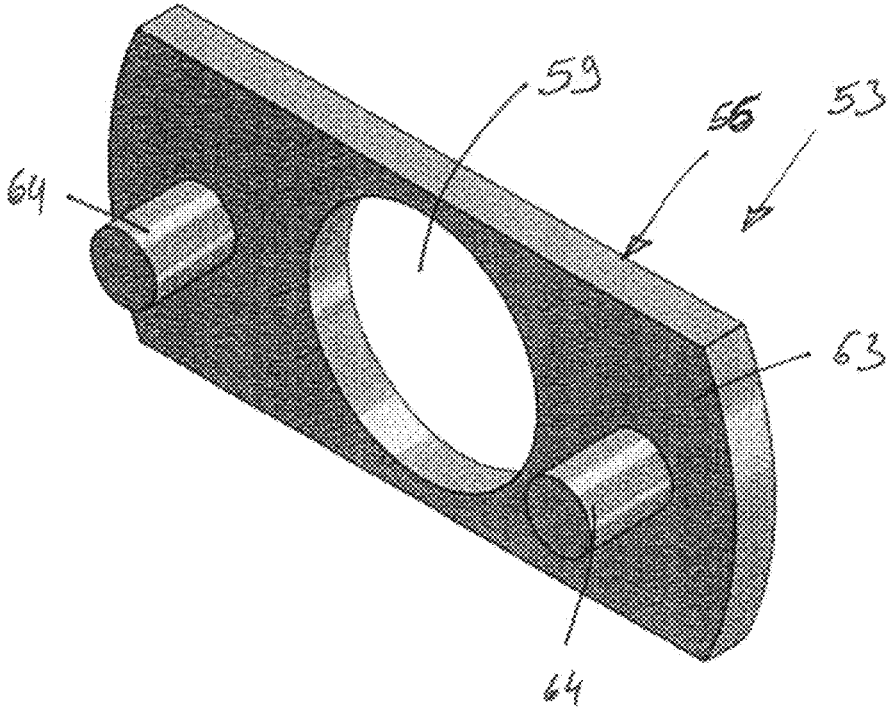
FIG. 10 is an isometric view of a lower part of the carriage body.
Figure 11:
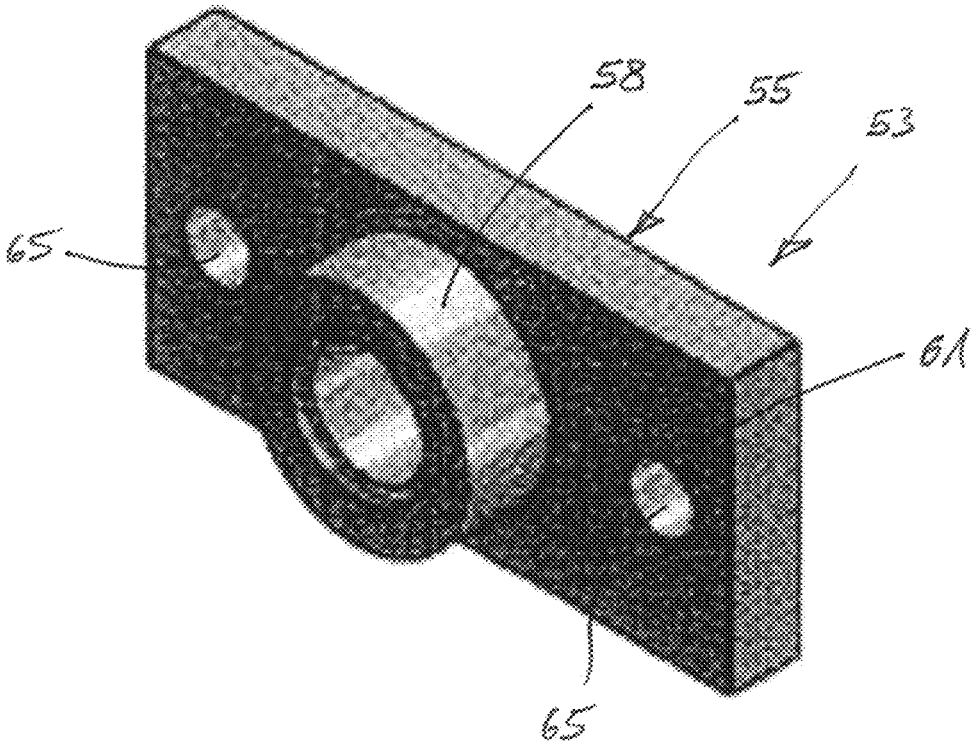
FIG. 11 is an isometric view of an upper part of the carriage body.
Figure 12:
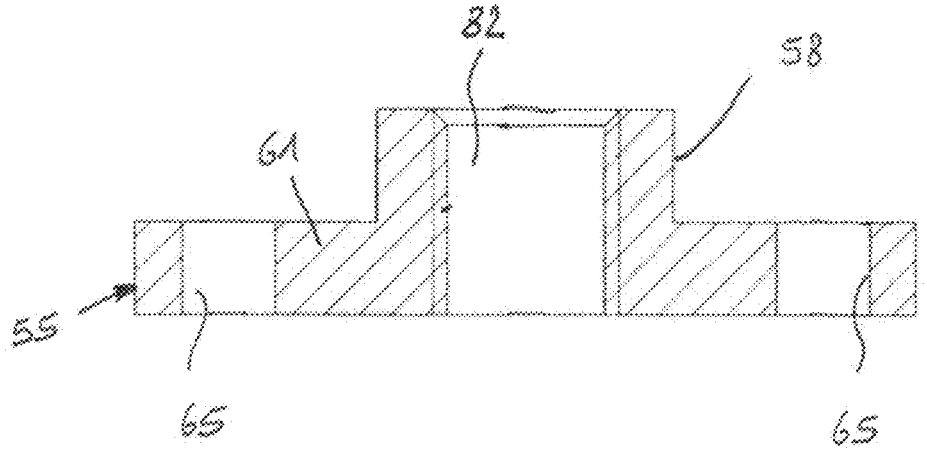
FIG. 12 is a cross section of the lower part.

According to FIG. 8, a tool engagement point 69 may be provided radially outwardly on socket element 54, via which a torque may be applied to socket element 54 by means of a tool (not shown here), in the form of a spanner, for example.

The door fitting 15 presented here may be adapted a range of different configurations particularly easily. All that has to be done is to loosen the threaded joint between socket element 54 and lower part 55 so that the associated carriage 42 or 44 is displaceable along the associated carriage guide 43 or 45 in the lengthwise direction of door fitting 15, in order to set the respective desired relative position between the respective screw-in opening 25 or 29 and outer doorplate 16. As soon as the desired relative position has been reached, the threaded joint between socket element 54 and lower part 55 is tightened, causing the respective carriage 42 or 44 to be fixed in place on the associated carriage guide 43 or 45.

Further components of door fitting 15 according to FIG. 4 may be an intrusion protection system 70 with the associated fastening screws 71, a bearing ring 72, a washer 73 and a locking ring 74 as well as a grub screw 75. Further component also appear in FIG. 5, such as further bearing rings 76, washers 77 and locking rings 78, and a further grub screw 79.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A door fitting for actuating a door locking mechanism of a door, comprising:

an outer doorplate for fitting on an outer side of the door, an inner doorplate for fitting on an inner side of the door, wherein the outer doorplate has a first screw-in opening in a first end section of the door fitting on an inner side facing towards the inner doorplate, into which the shaft of a first screw can be screwed to fasten the outer doorplate to the door, and a second screw-in opening in a second end section of the door fitting at a distance from the first end section in a lengthwise direction of the door fitting, into which a shaft of a second screw can be screwed to fasten the outer doorplate to the door, wherein the inner doorplate has a mounting plate and a cover plate that covers the mounting plate on an outer side facing away from the outer doorplate, wherein the mounting plate has a first passthrough opening in the first end section, through which the shaft of the first screw can pass for fastening the mounting plate to the door, and a second passthrough opening in the second end section, through which the shaft of the second screw can pass for fastening the mounting plate to the door, wherein the mounting plate has a first bearing point on the outside thereof in the area of the first passthrough opening, on which a head of the first screw may bear, and a second bearing point in the area of the second passthrough opening, on which a head of the second screw may bear, wherein the first screw-in opening and/or the second screw-in opening is/are arranged on the outer doorplate so as to be slidable in the lengthwise direction of the door fitting, so that various relative positions between the outer doorplate and the first screw-in opening and/or the second screw-in opening can be set, wherein the first passthrough opening with the first bearing point and/or the second passthrough opening with the second bearing point are configured such that they allow the respective screws to pass through and reach a bearing point when various relative positions exist between the outer doorplate and the first screw-in opening and/or the second screw-in opening.

2. A door fitting for actuating a door locking mechanism of a door, comprising:

an outer doorplate for fitting on an outer side of the door, an inner doorplate for fitting on an inner side of the door, wherein the outer doorplate has a first screw-in opening in a first end section of the door fitting on an inner side facing towards the inner doorplate, into which the shaft of a first screw can be screwed to fasten the outer doorplate to the door, and a second screw-in opening in a second end section of the door fitting at a distance from the first end section in a lengthwise direction of the door fitting, into which a shaft of a second screw can be screwed to fasten the outer doorplate to the door, wherein the inner doorplate has a mounting plate and a cover plate that covers the mounting plate on an outer side facing away from the outer doorplate, wherein the mounting plate has a first passthrough opening in the first end section, through which the shaft of the first screw can pass for fastening the mounting plate to the door, and a second passthrough opening in the second end section, through which the shaft of the second screw can pass for fastening the mounting plate to the door, wherein the mounting plate has a first bearing point on the outside thereof in the area of the first passthrough opening, on which a head of the first screw may bear, and a second bearing point in the area of the second passthrough opening, on which a head of the second screw may bear, wherein the first screw-in opening and/or the second screw-in opening is/are arranged on the outer doorplate so as to be displaceable in the lengthwise direction of the door fitting, so that various relative positions between the outer doorplate and the first screw-in opening and/or the second screw-in opening can be set, wherein the first passthrough opening with the first bearing point and/or the second passthrough opening with the second bearing point are configured such that they allow the respective screws to pass through and reach a bearing point when various relative positions exist between the outer doorplate and the first screw-in opening and/or the second screw-in opening;

wherein the first screw-in opening is conformed on a first carriage, which is arranged displaceably in the lengthwise direction of the door fitting in a first carriage guide fastened to the outer doorplate, and/or wherein the second screw-in opening is conformed on a second carriage which is arranged displaceably in the lengthwise direction of the door fitting in a second carriage guide fastened to the outer doorplate.

3. The door fitting according to claim 2, wherein the respective carriage guide has a bracket fastened to the outer doorplate and a guide opening that extends in the lengthwise direction of the door fitting, the bracket has a guide wall which is located at a distance from the inner side of the outer doorplate, in which the guide opening is conformed and delimited by two guide wall sections transversely to the lengthwise direction of the door fitting, that the respective carriage passes through the respective guide opening and engages with the guide wall sections.

4. The door fitting according to claim 3, wherein the respective carriage has seating groove for each guide wall section which extends in the lengthwise direction of the door fitting, and in which each such guide wall section engages.

5. The door fitting according to claim 4, wherein the respective carriage has a carriage body that is displaceable along the respective carriage guide and a socket element fastened to the carriage body which includes the respective screw-in opening.

6. The door fitting according to claim 5, wherein the seating grooves are conformed on the carriage body.

7. The door fitting according to claim 5, wherein the respective carriage body has a lower part and an upper part, the socket element has a screwing section with an external thread, the lower part has a socket section with internal thread, the upper part has a passthrough opening, the upper part is fastened to the lower part with the aid of the socket elements by passing the screwing section through the passthrough opening into the socket section.

8. The door fitting according to claim 7, wherein the lower part is arranged on an underside of the guide wall facing the inner side of the outer doorplate, so that the socket section is guided in the guide opening and a lower part base, from which the socket section protrudes engages behind the two guide wall sections transversely to the lengthwise direction of the door fitting, the upper part is arranged on an upper side of the guide wall facing away from the inner side of the outer doorplate, so that the passthrough opening is aligned with the socket section and an upper part base which includes the passthrough opening engages across the two guide wall sections transversely to the lengthwise direction of the door fitting.

9. The door fitting according to claim 8, wherein a protruding pin is conformed on both sides of the socket section on the lower part base, which pin passes through a pin passthrough opening conformed in the respective guide wall section and is inserted into a pin seating conformed on the upper part base, or a protruding pin is conformed on both sides of the passthrough opening on the upper part base, which pin passes through a pin passthrough opening conformed in the respective guide wall section and is inserted into a pin seating conformed on the lower part base.

10. The door fitting according to claim 9, wherein that the respective guide wall section has multiple separate pin passthrough openings for at least two predefined relative positions between the outer doorplate and the first screw-in opening and/or the second screw-in opening, which are located at a distance from each other in the lengthwise direction of the door fitting.

11. The door fitting according to claim 9, wherein the respective guide wall section has a common pin passthrough opening for at least two predefined relative positions between the outer doorplate and the first screw-in opening and/or the second screw-in opening, which extends in the lengthwise direction of the door fitting as an elongated slot.

12. The door fitting according to claim 11, wherein a screen is conformed in the common pin passthrough opening which has the form of an elongated slot, which screen allows the respective pin to pass through this common pin passthrough opening only when predefined relative positions exist between the outer doorplate and the first screw-in opening and/or the second screw-in opening, and prevents this pin that has passed through this common pin passthrough opening from being pushed in der lengthwise direction of the door fitting.

13. The door fitting according to claim 7, wherein the socket section protrudes axially into the passthrough opening.

14. The door fitting according to claim 5, wherein a tool engaging point is conformed radially outwardly on the socket element, via which a torque can be applied to the socket element by means of a tool.

15. A door, comprising a door locking mechanism for securing the door when the door is closed in door frame, the door fitting according to claim 2 for actuating the door locking mechanism.

* * * * *